US010912969B2

(12) United States Patent
Matsunaga et al.

(10) Patent No.: US 10,912,969 B2
(45) Date of Patent: Feb. 9, 2021

(54) GOLF CLUB HEAD

(71) Applicant: Sumitomo Rubber Industries, Ltd., Hyogo (JP)

(72) Inventors: Kiyofumi Matsunaga, Kobe (JP); Yasushi Sugimoto, Kobe (JP); Yuki Motokawa, Kobe (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 0 days.

(21) Appl. No.: 16/594,282

(22) Filed: Oct. 7, 2019

(65) Prior Publication Data

US 2020/0121998 A1 Apr. 23, 2020

(30) Foreign Application Priority Data

Oct. 17, 2018 (JP) ..... 2018-196239

(51) Int. Cl.
*A63B 53/04* (2015.01)

(52) U.S. Cl.
CPC ..... *A63B 53/047* (2013.01); *A63B 53/0408* (2020.08); *A63B 53/0433* (2020.08)

(58) Field of Classification Search
CPC ..... A63B 53/0475; A63B 53/047; A63B 2053/0479
USPC ..... 473/324–350
See application file for complete search history.

(56) References Cited

U.S. PATENT DOCUMENTS 5,419,560 A * 5/1995 Bamber ..... A63B 53/04 473/350
5,439,223 A * 8/1995 Kobayashi ..... A63B 53/04 473/334
5,447,311 A * 9/1995 Viollaz ..... A63B 53/04 473/342
5,547,194 A * 8/1996 Aizawa ..... A63B 53/04 473/350
5,601,501 A * 2/1997 Kobayashi ..... A63B 53/04 473/350
5,643,103 A * 7/1997 Aizawa ..... A63B 53/04 473/290
5,683,310 A * 11/1997 Chen ..... A63B 53/04 473/349
5,697,855 A * 12/1997 Aizawa ..... A63B 53/04 473/350

(Continued)

FOREIGN PATENT DOCUMENTS

JP 06182006 A * 7/1994 ..... A63B 53/047
JP 06205858 A * 7/1994 ..... A63B 53/047

(Continued)

*Primary Examiner* — Alvin A Hunter

(74) *Attorney, Agent, or Firm* — Studebaker & Brackett PC

(57) ABSTRACT

A head includes a head body including a sole and a face plate fixed to the head body. The face plate includes a plate front surface that forms a part of a hitting face, a plate rear surface, and a plate side surface. The head body includes an opening at which the face plate is disposed, and a back support portion that supports the face plate from a back side. The back support portion includes a back receiving surface forming an abutting region by abutting on an outer peripheral edge portion of the place rear surface, and a rear surface that is a surface opposite to the back receiving surface. A face-peripheral-side end of the rear surface is located on a face peripheral side relative to a face-center-side end of the abutting region.

19 Claims, 14 Drawing Sheets

(56) References Cited

U.S. PATENT DOCUMENTS 5,735,755 A * 4/1998 Kobayashi ..... A63B 53/04 473/342
5,816,936 A * 10/1998 Aizawa ..... A63B 53/04 473/342
5,871,408 A * 2/1999 Chen ..... A63B 53/04 473/409
5,899,820 A * 5/1999 Minematsu ..... A63B 53/04 473/329
5,967,903 A * 10/1999 Cheng ..... A63B 53/04 473/342
6,001,032 A * 12/1999 Onuki ..... A63B 53/04 473/342
6,045,456 A * 4/2000 Best ..... A63B 53/04 473/291
6,220,971 B1 * 4/2001 Takeda ..... A63B 53/04 473/342
6,769,998 B2 * 8/2004 Clausen ..... A63B 53/0466 473/342
6,814,674 B2 * 11/2004 Clausen ..... A63B 53/0466 473/342
6,923,733 B2 * 8/2005 Chen ..... A63B 53/047 473/305
7,018,305 B2 * 3/2006 Sugimoto ..... A63B 53/04 473/342
7,022,031 B2 * 4/2006 Nishio ..... A63B 53/04 473/342
7,025,693 B2 * 4/2006 Sugimoto ..... A63B 53/04 473/342
7,025,695 B2 * 4/2006 Mitsuba ..... A63B 60/00 473/349
7,232,380 B2 * 6/2007 Nakahara ..... A63B 53/047 473/324
7,235,023 B2 * 6/2007 Sugimoto ..... A63B 53/047 473/291
7,578,754 B2 * 8/2009 Nakamura ..... A63B 53/047 473/342
7,713,141 B2 * 5/2010 Yamamoto ..... A63B 53/047 473/332
7,892,106 B2 * 2/2011 Matsunaga ..... A63B 53/047 473/290
7,922,604 B2 * 4/2011 Roach ..... A63B 53/047 473/350
8,182,362 B2 * 5/2012 Kusumoto ..... A63B 53/047 473/324
8,342,985 B2 * 1/2013 Hirano ..... A63B 53/047 473/350
8,920,259 B2 * 12/2014 Takechi ..... A63B 53/047 473/329
2003/0078112 A1 * 4/2003 Sugimoto ..... A63B 53/047 473/342
2003/0119602 A1 * 6/2003 Kennedy, III ..... A63B 53/047 473/342
2005/0130766 A1 * 6/2005 Nakahara ..... A63B 53/047 473/349
2013/0324297 A1 12/2013 Larson

FOREIGN PATENT DOCUMENTS

JP 09154987 A * 6/1997
JP 09215793 A * 8/1997
JP 09276456 A * 10/1997 ..... A63B 60/52
JP 09327534 A * 12/1997
JP 10024131 A * 1/1998
JP 10033730 A * 2/1998
JP 10094625 A * 4/1998
JP 10151230 A * 6/1998
JP 10155946 A * 6/1998
JP 10248971 A * 9/1998
JP 10248972 A * 9/1998
JP 10248973 A * 9/1998
JP 10314347 A * 12/1998
JP 10314348 A * 12/1998
JP 11244431 A * 9/1999
JP 2000279561 A * 10/2000 ..... A63B 53/04
JP 2001095961 A * 4/2001
JP 2001149513 A * 6/2001
JP 2001170222 A * 6/2001
JP 2001212271 A * 8/2001
JP 2002143354 A * 5/2002
JP 2003062135 A * 3/2003
JP 2003093558 A * 4/2003
JP 2003117032 A * 4/2003 ..... A63B 53/047
JP 2003126313 A * 5/2003
JP 2003144592 A * 5/2003 ..... A63B 53/04
JP 2004065853 A * 3/2004
JP 2004089440 A * 3/2004 ..... A63B 53/047
JP 2004-188124 A 7/2004
JP 2005230186 A * 9/2005
JP 2006122544 A * 5/2006
JP 2007260316 A * 10/2007
JP 2007275622 A * 10/2007
JP 2008079979 A * 4/2008
JP 2009226062 A * 10/2009 ..... A63B 53/047
JP 2010-29380 A 2/2010
JP 2010-110468 A 5/2010
JP 5708870 B1 4/2015
JP 2015-517882 A 6/2015
JP 2016-87008 A 5/2016
JP 2019017523 A * 2/2019 ..... A63B 53/0475
JP 2019017525 A * 2/2019 ..... A63B 60/02

* cited by examiner

GOLF CLUB HEAD

This application claims priority on Patent Application No. 2018-196239 filed in JAPAN on Oct. 17, 2018. The entire contents of this Japanese Patent Application are hereby incorporated by reference.

BACKGROUND OF THE INVENTION

Field of the Invention

The present disclosure relates to golf club heads.

Description of the Related Art

There has been known a head that includes a head body and a face plate fixed to the head body. JP708870B1 discloses an iron-type golf club head that includes: a plate-shaped face member having a face surface and a face back surface; and a head body having a frame part that holds an outer peripheral portion of the face member. In this head, the frame part includes a support wall portion having a receiving surface that can abut on an outer peripheral portion of the face back surface, and the support wall portion has at least one aperture.

SUMMARY OF THE INVENTION

The present inventors have found a new structure capable of enhancing rebound performance of a head including a face plate.

The present disclosure provides a new structure that enhances rebound performance of a head including a face plate.

A golf club head according to one aspect includes a head body including a sole, and a face plate fixed to the head body. The face plate includes a plate front surface that forms a part of a hitting face, a plate rear surface that is a surface opposite to the plate front surface, and a plate side surface that extends between the plate front surface and the plate rear surface. The head body includes an opening at which the face plate is disposed, and a back support portion that supports the face plate from a back side. The back support portion includes a back receiving surface that forms an abutting region by abutting on an outer peripheral edge portion of the plate rear surface, and a rear surface that is a surface opposite to the back receiving surface. The rear surface has a face-peripheral-side end that is located on a face peripheral side relative to a face-center-side end of the abutting region.

DESCRIPTION OF THE PREFERRED EMBODIMENTS

In the present application, the following terms are defined.

[Toe-Heel Direction]

The extending direction of a longest face line is defined as a toe-heel direction. The meanings of the terms "toe side" and "heel side" in the present application are interpreted based on this toe-heel direction.

[Up-Down Direction]

A direction that is parallel to a hitting face and that is perpendicular to the toe-heel direction is defined as an up-down direction. In the present application, the meanings of the terms "upper side" and "lower side" are interpreted based on this up-down direction.

[Face-Back Direction]

A direction perpendicular to the hitting face is defined as a face-back direction. When the hitting face is a curved surface, a direction of a line normal to the hitting face at a face center is defined as a face-back direction. The meanings of the terms "face side" and "back side" in the present application are interpreted based on this face-back direction.

[Face Center]

On the center position in the toe-heel direction of the longest face line, the center position in the up-down direction of the hitting face is the face center.

[Face Peripheral Side]

A face peripheral side in the present application is defined as a concept that means positions being away from the center of a head. In a sole-side region of the head, the face peripheral side means the lower side. In a top-side region of the head, the face peripheral side means the upper side. In a toe-side region of the head, the face peripheral side means the toe side. In a heel-side region of the head, the face peripheral side means the heel side.

[Face Center Side]

In the present application, a face center side is defined as a term that means positions being closer to the center of the head. In the sole-side region of the head, the face center side means the upper side. In the top-side region of the head, the face center side means the lower side. In the toe-side region of the head, the face center side means the heel side. In the heel-side region of the head, the face center side means the toe side. The term "face center side" is the antonym of "face peripheral side".

[Sole-Side Region, Top-Side Region, Toe-Side Region, and Heel-Side Region]

As to portions of the head, it may be difficult to determine which of the sole side, the top side, the toe side, and the heel side, the portion concerned belongs to. In this case, the sole-side region, the top-side region, the toe-side region, and the heel-side region can be defined using planes Pa, Pb, Pc, and Pd as references as shown below.

Figure 1:
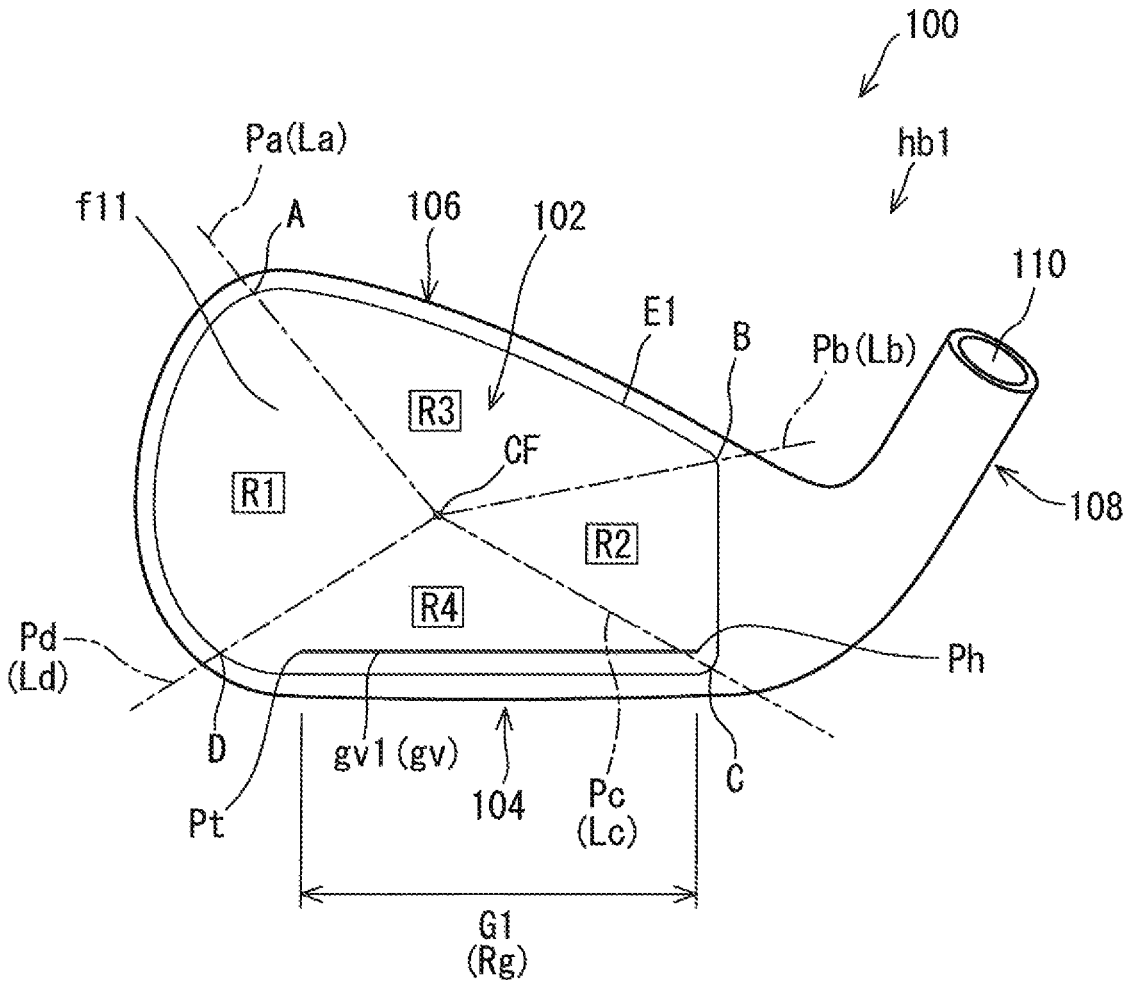
FIG. 1 is a front view of a golf club head according to a first embodiment.

As shown in FIG. 1, straight lines La, Lb, Lc, and Ld can be drawn from a centroid CF of a plate front surface f11. The straight line La is a straight line that connects the centroid CF and a point A. The straight line Lb is a straight line that connects the centroid CF and a point B. The straight iine Lc is a straight line that connects the centroid CF and a point C. The straight line Ld is a straight line that connects the centroid CF and a point D. The point A is a point having a curvature radius of smallest in a part of an outer edge line E1 which is present in a toe upper region. The toe upper region means a region located on the toe side and on the upper side with respect to the centroid CF of the plate front surface f11. The point B is a point having a curvature radius of smallest in a part of the outer edge line E1 which is present in a heel upper region. The heel upper region means a region located on the heel side and on the upper side with respect to the centroid CF of the plate front surface f11. The point C is a point having a curvature radius of smallest in a part of the outer edge line E1 which is present in a heel lower region. The heel lower region means a region located on the heel side and on the lower side with respect to the centroid CF of the plate front surface f11. The point D is a point having a curvature radius of smallest in a part of the outer edge line E1 which is present in a toe lower region. The toe lower region means a region located on the toe side and on the lower side with respect to the centroid CF of the plate front surface f11. The outer edge line E1 is the outer edge line of the plate front surface f11, and is present on a hitting face 102.

The plane Pa is defined as a plane that includes the straight line La and is perpendicular to the plate front surface f11. The plane Pb is defined as a plane that includes the straight line Lb and is perpendicular to the plate front surface f11. The plane Pc is defined as a plane that includes the straight line Lc and is perpendicular to the plate front surface f11. The plane Pd is defined as a plane that includes the straight line Ld and is perpendicular to the plate front surface f11. These four planes Pa, Pb, Pc, and Pd can compart a head, a head body, a first member, and a face plate into a toe-side region R1, a heel-side region R2, a top-side region R3, and a sole-side region R4 (see FIG. 1).

The following will describe embodiments in detail with appropriate reference to the drawings.

Figure 2:
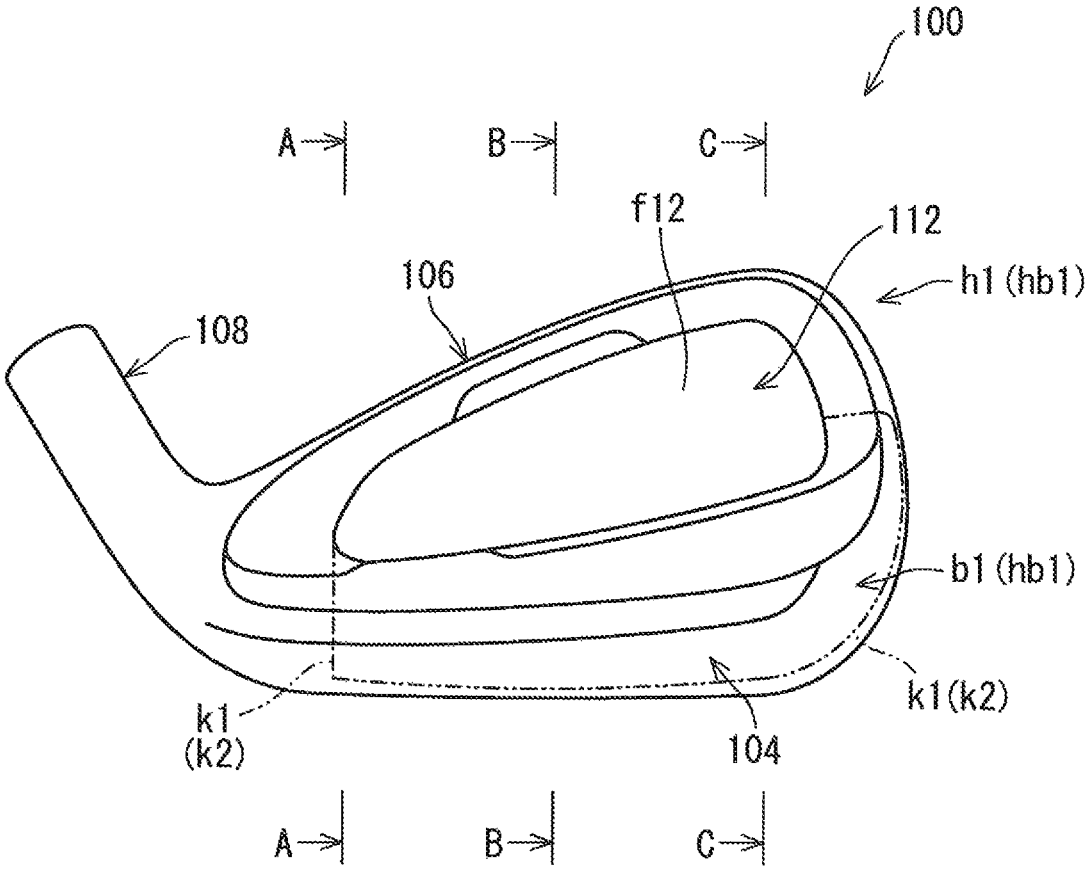
FIG. 2 is a back view of the head in FIG. 1.
Figure 3:
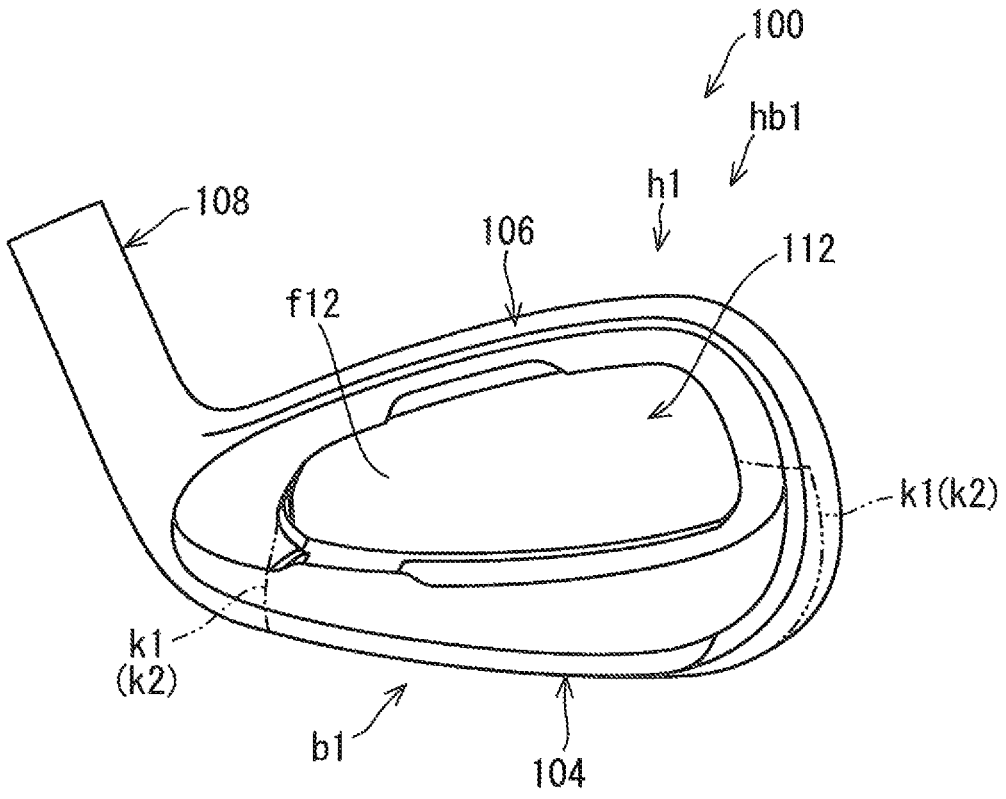
FIG. 3 is a perspective view of the head in FIG. 1.

FIG. 1 is a front view of a head 100 according to a first embodiment. FIG. 2 is a back view of the head 100. FIG. 3 is a perspective view of the head 100.

The head 100 includes the hitting face 102, a sole 104, a top surface 106, and a hosel 108. The hosel 108 includes a hosel hole 110. A shaft (not shown in the drawings) is attached to the hosel hole 110.

The hitting face 102 includes a plurality of face lines gv. The plurality of face lines gv include a longest face line gv1. Of the plurality of face lines gv, only the longest face line gv1 located on the sole-most side is shown in FIG. 1.

The head 100 is an iron-type golf club head. The hitting face 102 is a flat surface. As shown in FIG. 2 and FIG. 3, the head 100 includes a back cavity 112. The head 100 is a cavity back iron.

The head 100 need not necessarily be an iron-type head. The head 100 may be a wood-type head, a utility-type head, or a putter-type head.

Figure 4:
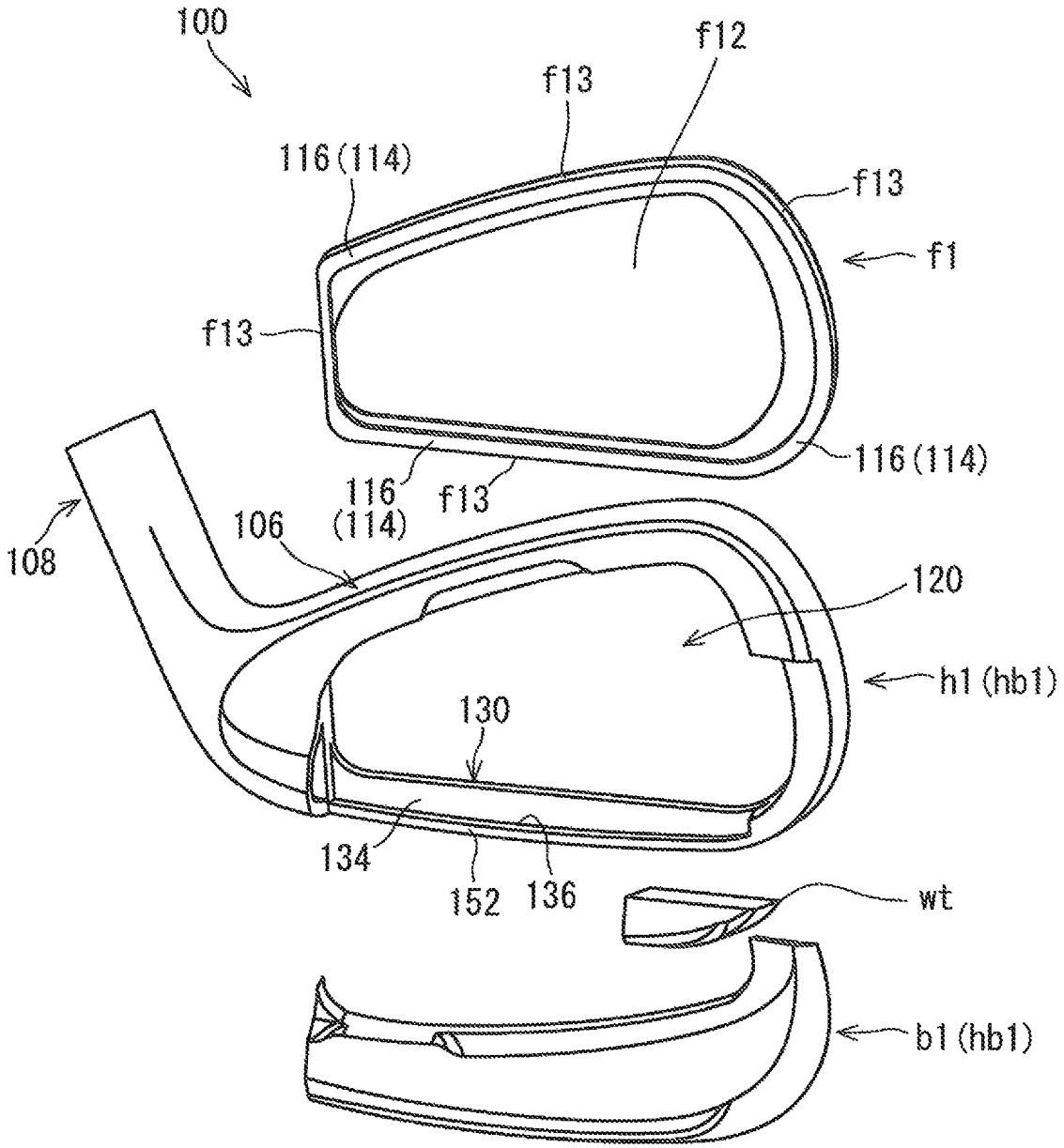
FIG. 4 is an exploded perspective view of the head in FIG. 1.

FIG. 4 is an exploded perspective view of the head 100. The head 100 is formed by a plurality of members. The head 100 includes a head body hb1 and a face plate f1. The face plate f1 is fixed to the head body hb1. The head body hb1 includes a first member h1 and a second member b1. The second member b1 includes a weight wt.

The face plate f1 includes the plate front surface f11, a plate rear surface f12, and a plate side surface f13. As shown in FIG. 1, the plate front surface f11 forms a part of the hitting face 102. The plate front surface f11 forms a large part of the hitting face 102. The plate rear surface f12 is a surface opposite to the plate front surface f11. The plate side surface f13 extends between the outer edge of the plate front surface f11 and the outer edge of the plate rear surface f12.

The plate rear surface f12 includes an outer peripheral edge portion 114. In the present embodiment, the outer peripheral edge portion 114 is formed as a protruding portion. That is, as shown in FIG. 4, the outer peripheral edge portion 114 of the plate rear surface f12 is a peripheral edge protruding portion 116. The peripheral edge protruding portion 116 extends along the outer edge of the plate rear surface f12. The peripheral edge protruding portion 116 is formed over the entire periphery of the plate rear surface f12.

Figure 5:
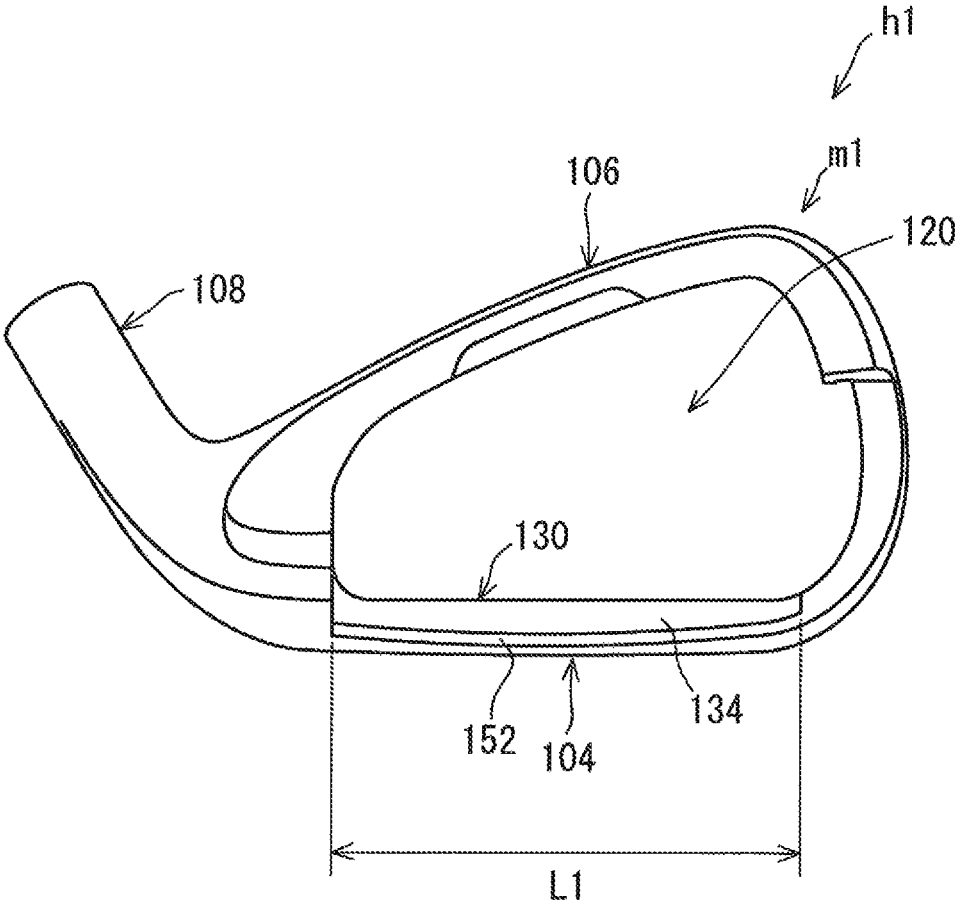
FIG. 5 is a back view of a first member.
Figure 6:
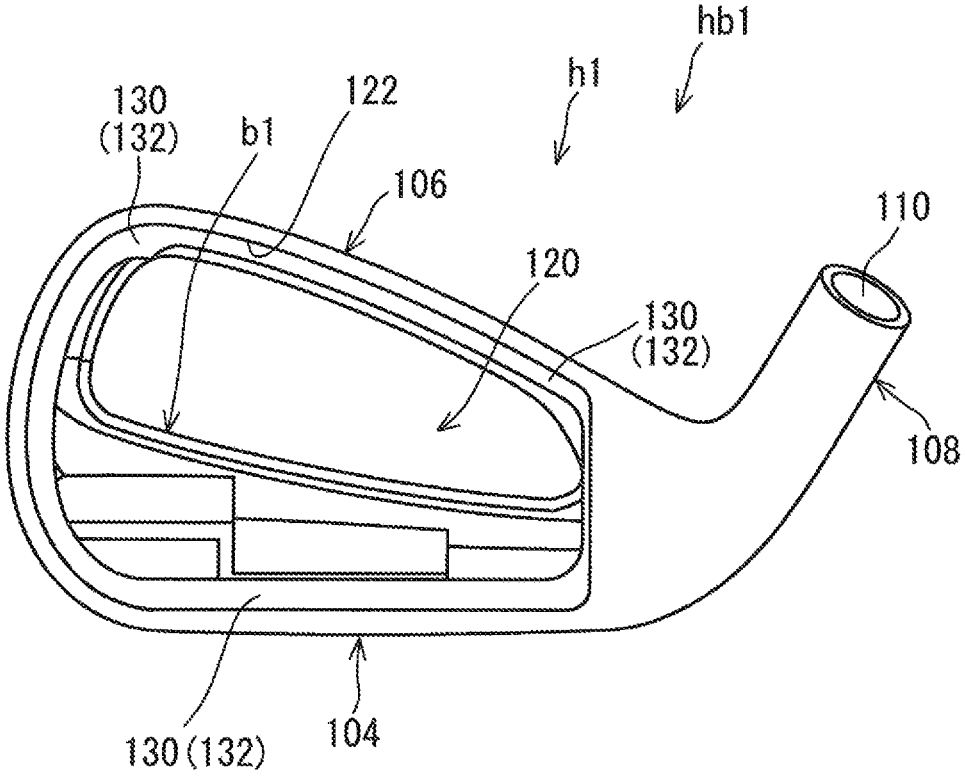
FIG. 6 is a front view of a head body.

FIG. 5 is a back view of the first member h1. FIG. 6 is a front view of the head body hb1.

The head body hb1 includes the first, member h1 and the second member b1. The head body hb1 is formed by joining the second member b1 to the first member h1. The second member b1 is fixed to the back side of the first member h1. The head body hb1 may be entirely integrally formed as a single-piece member.

As shown in FIG. 5, the first member h1 includes an opening 120. The opening 120 is a through hole. The opening 120 includes an opening inner surface 122. The face plate f1 is disposed at the opening 120. The face plate f1 is fitted into the opening 120. The opening 120 is covered with the face plate f1. The first member h1 forms a frame body ml which retains the face plate f1.

The first member h1 forms the entirety of the hosel 108. The first member h1 forms the entirety of the top surface 106. The first member h1 forms a part (front portion) of the sole 104. The first member h1 forms a part (peripheral edge portion) of the hitting face 102.

The second member b1 is attached to the back side of the first member h1. The second member b1 forms a part (rear portion) of the sole 104. The second member b1 has a center of gravity that is located on the lower side relative to the center of gravity of the head 100. The center of gravity of the second member b1 is located on the back side relative to the center of gravity of the head 100.

The material of the second member b1 may be the same as the material of the first member h1. The material of the second member b1 may be different from the material of the first member h1. The specific gravity of the second member b1 may be greater than the specific gravity of the first member h1. In this case, the entirety of the second member b1 can be used as a weight body. From the viewpoint of joining strength, the second member b1 is preferably capable of being welded to the first member h1.

A two-dot chain line in FIG. 2 and FIG. 3 indicates a boundary line k1 between the second member b1 and the first member h1. In the head 100 as a completed product which has been subjected to surface finishing, the boundary line k1 is not visually recognized. In the present embodiment, the second member b1 is welded to the first member h1. The boundary line k1 is also a welding position k2. A joining method other than welding may be employed.

The second member b1 includes the weight wt. The weight wt is fixed to the inside of the second member b1. The weight wt has a center of gravity that is located on the toe side relative to the center of gravity of the head 100. The center of gravity of the weight wt is located on the lower side relative to the center of gravity of the head 100. The specific gravity of the weight wt is greater than the specific gravity of the first member h1. The specific gravity of the weight wt is greater than the specific gravity of the second member b1.

Figure 7:
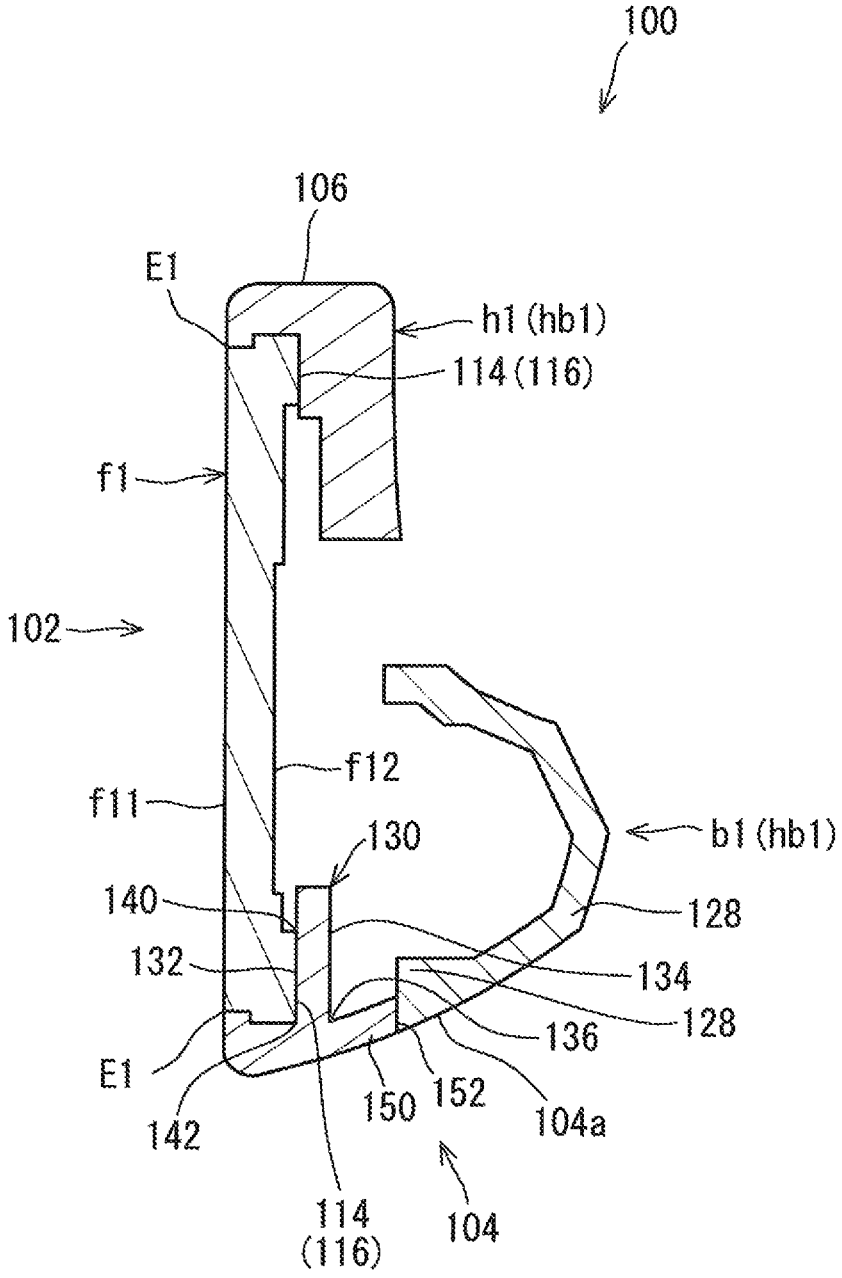
FIG. 7 is a cross-sectional view taken along line A-A in FIG. 2.
Figure 8:
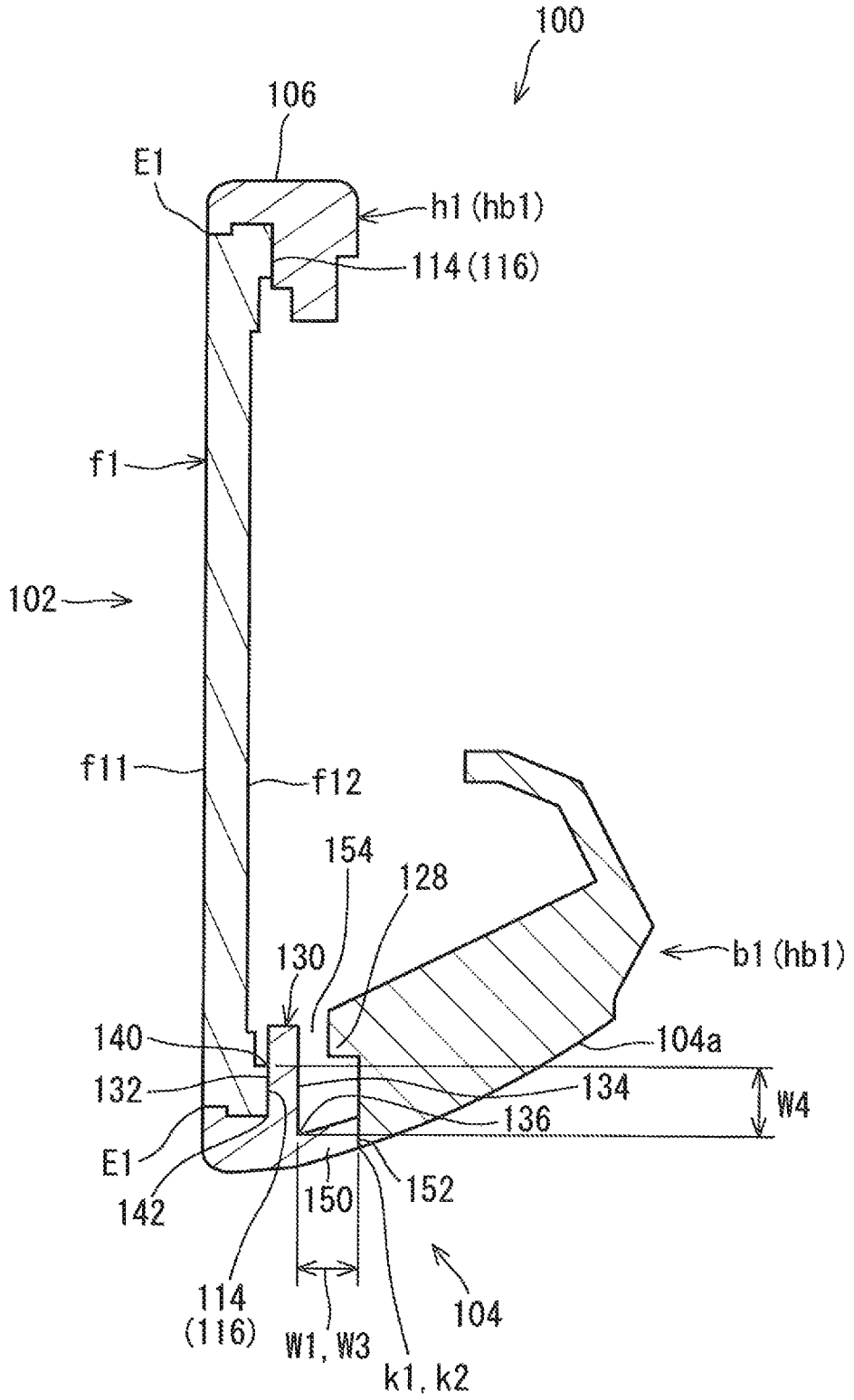
FIG. 8 is a cross-sectional view taken along line B-B in FIG. 2.
Figure 9:
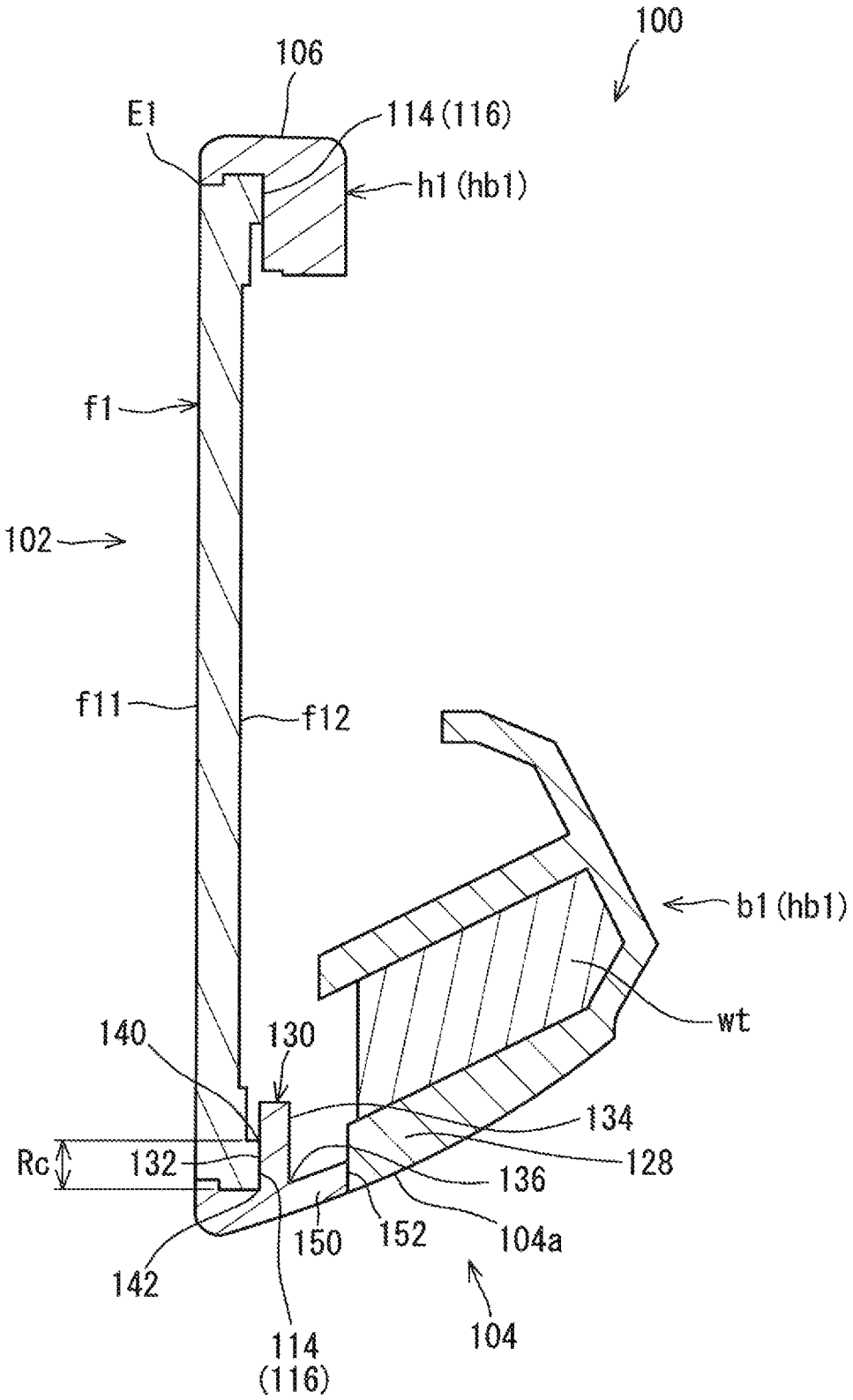
FIG. 9 is a cross-sectional view taken along line C-C in FIG. 2.

FIG. 7 is a cross-sectional view taken along line A-A in FIG. 2. FIG. 8 is a cross-sectional view taken along line B-B in FIG. 2. FIG. 9 is a cross-sectional view taken along line C-C in FIG. 2.

As shown in FIG. 7, FIG. 8, and FIG. 9, the head body hb1 (the first member h1) includes a back support portion 130 which supports the face plate f1 from the back side. The back support portion 130 is provided in the sole-side region of the head body hb1 (the first member h1). The back support portion 130 is a protruding portion (wall) extending from the toe side to the heel side (see FIG. 4 and FIG. 5). The back support portion 130 is protruded toward the upper side from the inner surface of the sole 104. The back support portion 130 is spaced from the second member b1.

The back support portion 130 includes a back receiving surface 132. The back receiving surface 132 is the front surface (surface on the face side) of the back support portion 130. The back receiving surface 132 forms an abutting region Rc by abutting on the outer peripheral edge portion 114 of the plate rear surface f12 (see FIG. 9). The back receiving surface 132 is brought into surface-contact with the outer peripheral edge portion 114 (the peripheral edge protruding portion 116) of the plate rear surface f12. In the present embodiment, the back receiving surface 132 is a flat surface.

The back support portion 130 includes a rear surface 134. The rear surface 134 is the back surface of the back support portion 130. The rear surface 134 is a surface opposite to the back receiving surface 132. In the present embodiment, the rear surface 134 is a flat surface.

The rear surface 134 is spaced from the second member b1. The second member b1 includes a rearward disposed portion 128 located on the back side of the rear surface 134. The rearward disposed portion 128 is located on the back side of the back receiving surface 132. The rearward disposed portion 128 is located on the back side of the abutting region Rc. The rearward disposed portion 128 is a part of the head body hb1. When the second member b1 is attached to the first member h1, the rear surface 134 cannot be visually recognized from the back side. When the second member b1 is not attached to the first member h1, the rear surface 134 can be visually recognized from the back side. In a state of the first member h1 being alone, the rear surface 134 can be visually recognized from the back side.

The rear surface 134 includes an end 136 on the face peripheral side. When the back support portion 130 is located in the sole-side region, the face peripheral side means the lower side. The end 136 is the lower end of the rear surface 134. In the present embodiment, the end 136 is an intersection line between the inner surface of the sole 104 and the rear surface 134.

The abutting region Rc includes an end 140 on the face center side and an end 142 on the face peripheral side. For the back support portion 130 located in the sole-side region, the face center side means the upper side. The end 140 is the upper end of the abutting region Rc. The end 142 is the lower end of the abutting region Rc.

The lower end 136 of the rear surface 134 is located on the lower side relative to the upper end 140 of the abutting region Rc (see FIG. 7, FIG. 8 and FIG. 9).

The head 100 includes a portion in which the lower end 136 of the rear surface 134 is located on the lower side relative to the lower end 142 of the abutting region Rc (see FIG. 8). The head 100 includes a portion in which the lower end 136 of the rear surface 134 is located on the upper side relative to the lower end 142 of the abutting region Rc (see FIG. 9).

The sole 104 includes a thin portion 150 on the back side of the rear surface 134. The thin portion 150 is the thinnest portion in the sole 104. The thin portion 150 has a thickness of less than or equal to 4 mm. This thickness is measured along the up-down direction. The thin portion 150 forms a part of the sole 104. The outer surface of the thin portion 150 is a sole surface 104*a*. The lower end 136 of the rear surface 134 is the intersection line between the inner surface of the thin portion 150 and the rear surface 134.

The thin portion 150 extends from the lower end 136 of the rear surface 134 toward the back side. The thin portion 150 connects the lower end 136 of the rear surface 134 and the second member b1 to each other. The thin portion 150 includes a rear end surface 152 that is joined to the second member b1.

As shown in FIG. 8, a clearance 154 is provided between the back support portion 130 and the rearward disposed portion 128. Deformation caused by hitting brings the back support portion 130 closer to the rearward disposed portion 128. When bending of the hitting face 102 is large, the back support portion 130 comes into contact with the rearward disposed portion 128. That is, the bending of the hitting face 102 caused by hitting can bring the back support portion 130 into contact with the rearward disposed portion 128. When the amount of displacement of the back support portion 130 reaches the width in the face-back direction of the clearance 154, the back support portion 130 comes into contact with the rearward disposed portion 128. The rearward disposed portion 128 prevents the amount of displacement of the back support portion 130 from becoming a predetermined amount or greater. The rearward disposed portion 128 suppresses reduction in durability due to excessively large bending of the hitting face 102. The rearward disposed portion 128 suppresses a COR to a predetermined value or smaller. The rearward disposed portion 128 prevents an excessively large COR, and inhibits a ball from excessively flying.

The hitting face 102 has a specific measurement point that is a point for measuring a COR, the measurement of the COR at the specific measurement point bringing the back support portion 130 into contact with the rearward disposed portion 128. That is, when the COR is measured at the specific measurement point, the back support portion 130 comes into contact with the rearward disposed portion 128. The specific measurement point is a point on the hitting face 102. The specific measurement point may be the face center. The specific measurement point may be a maximum restitution point of the hitting face 102. The maximum restitution point is a point where the COR becomes maximum. In the head having the specific measurement point, the rearward disposed portion 128 can suppress an excessively large deformation of the hitting face 102, reduction in durability can be suppressed, and an excessively large COR can be prevented.

Preferably, in the measurement of the COR at the maximum restitution point, the back support portion 130 comes into contact with the rearward disposed portion 128. This contact enables the COR at the maximum restitution point to be effectively suppressed, and thus the durability can be improved. The COR at the maximum restitution point is preferably less than or equal to 0.836. The COR at the specific measurement point is preferably less than or equal to 0.836. A method for measuring the COR will be described later. Preferably, the COR at the maximum restitution point is less than or equal to the COR of a baseline plate specified in the measurement method described later.

Figure 10:
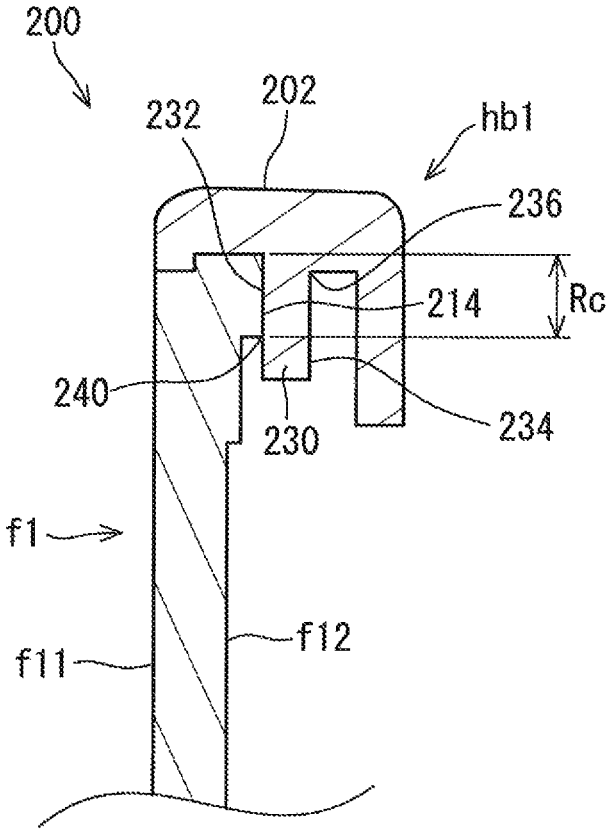
FIG. 10 is a cross-sectional view of a golf club head according to a second embodiment.

FIG. 10 is a cross-sectional view showing a portion on the top side of a head 200 according to a second embodiment. The head 200 includes a head body hb1 and a face plate f1. The head body hb1 forms a top surface 202.

The head body hb1 of the head 200 includes a back support portion 230 which supports the face plate f1 from the back side. The back support portion 230 is provided in the tcp-side region of the head body hb1. The back support portion 230 is a protruding portion (wall) extending from the toe side to the heel side. The back support, portion 230 protrudes toward the lower side.

The back support portion 230 includes a back receiving surface 232. The back receiving surface 232 is the front surface (surface on the face side) of the back support portion 230. The back receiving surface 232 forms an abutting region Rc by abutting on an outer peripheral edge portion 214 of a plate rear surface f12. The back receiving surface 232 is brought into surface-contact with the outer peripheral edge portion 214 of the plate rear surface f12.

The back support portion 230 includes a rear surface 234. The rear surface 234 is the back surface of the back support portion 230. The rear surface 234 is a surface opposite to the back receiving surface 232.

The rear surface 234 includes an end 236 on the face peripheral side. In the present embodiment, the back support portion 230 is located in the top-side region. Thus, the face peripheral side means the upper side. The end 236 is the upper end of the rear surface 234.

The abutting region Rc includes an end 240 on the face center side. In the present embodiment, the back support portion 230 is located in the top-side region. Thus, the face center side means the lower side. The end 240 is the lower end of the abutting region Rc. The upper end 236 of the rear surface 234 is located on the upper side relative to the lower end 240 of the abutting region Rc.

The head 200 as well as the above-described head 100 satisfies the following configuration X.

[Configuration X]: The face-peripheral-side end of the rear surface of a back support portion is located on the face peripheral side relative to the face-center-side end of an abutting region.

Examples of the configuration X include a configuration X1, a configuration X2, a configuration X3, and a configuration X4 as shown below.

[Configuration X1]: The back support portion is located in the sole-side region, and includes the rear surface having a lower end that is located on the lower side relative to the upper end of the abutting region.

[Configuration X2]: The back support portion is located in the top-side region, and includes the rear surface having an upper end that is located on the upper side relative to the lower end of the abutting region.

[Configuration X3]: The back support portion is located in the toe-side region, and includes the rear surface having a toe-side end that is located on the toe side relative to a heel-side end of the abutting region.

[Configuration X4]: The back support portion is located in the heel-side region, and includes the rear surface having a heel-side end that is located on the heel side relative to a toe-side end of the abutting region.

The head 100 of the first embodiment is an example of a head that satisfies the configuration X1. The head 200 of the second embodiment is an example of a head that satisfies the configuration X2.

Bending deformation toward the back side occurs in the face plate f1 at impact. By the bending deformation, the back support portion can be so deformed as to lean toward the back side (hereinafter, referred to as leaning deformation), the leaning deformation starting from the face-peripheral-side end of the rear surface. The configuration X facilitates the leaning deformation. As a result, the deformation of the face plate f1 becomes large, and the rebound performance can be improved.

The configuration X particularly enhances the rebound performance in the vicinity of a region in which the configuration X is located. The configuration X1 particularly enhances the rebound performance on the lower side of the hitting face. The configuration X2 particularly enhances the rebound performance on the upper side of the hitting face. The configuration X3 particularly enhances the rebound performance on the toe side of the hitting face. The configuration X4 particularly enhances the rebound performance on the heel side of the hitting face.

The head including the configuration X has at least one configuration selected from the group consisting of the configuration X1, the configuration X2, the configuration X3, and the configuration X4. The head may have two or more configurations selected from the group consisting of the configuration X1, the configuration X2, the configuration X3, and the configuration X4. The head may have three or more configurations selected from the group consisting of the configuration X1, the configuration X2, the configuration X3, and the configuration X4. The head may have the configuration X1, the configuration X2, the configuration X3, and the configuration X4. The head may have the configuration X1 and the configuration X2. The head may have the configuration X3 and the configuration X4.

The back support portion 130 need not necessarily be formed to surround the entire periphery of the opening 120. The back support portion 130 may have a gap so that the back support portion 130 partially surround the opening 120. For example, the gap in which the back support portion 130 is not formed may be present in the sole-side region. A through hole that penetrates the sole 104 may be provided in the gap in which the back support portion 130 is not formed, for example.

The center portion of the face plate f1 is more likely to deform than the peripheral portion of the face plate f1. The rebound performance of the peripheral portion tends to be lower than the rebound performance of the center portion. In contrast, the configuration X increases the deformation of the back support portion which abuts on the outer peripheral edge portion of the plate rear surface, and thus enhances the rebound performance of the peripheral portion of the hitting face. As a result, the difference in the coefficient of restitution between the peripheral portion and the center portion of the hitting face can be reduced.

Figure 11:
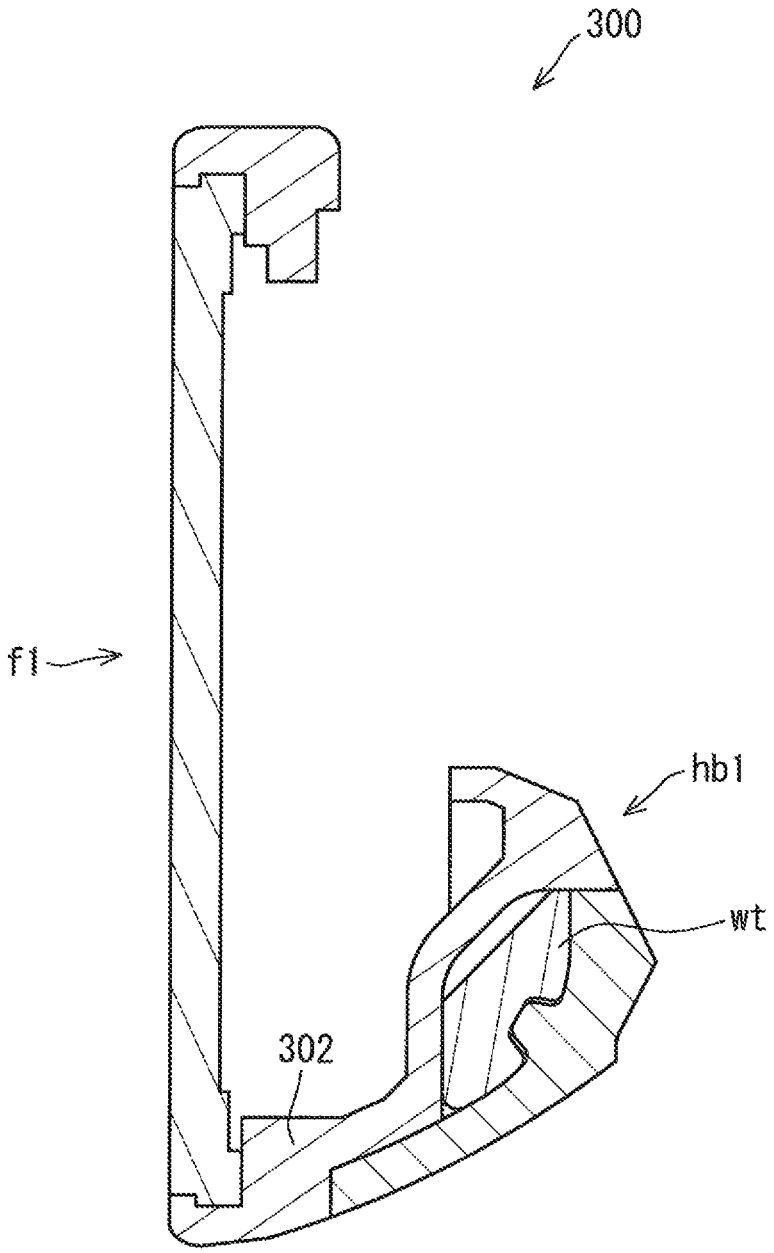
FIG. 11 is a cross-sectional view of a golf club head of Comparative Example.

FIG. 11 is a cross-sectional view of a head 300 of Comparative Example. In the head 300, a face plate f1 is attached to an opening of a head body hb1. In the head 300, the rigidity of a back support portion 302 in the scle-side region is high. Therefore, the coefficient of restitution on the lower side of the hitting face is low. In contrast, in the case of the head 100 of the first embodiment which includes the configuration X1, the coefficient of restitution on the lower side of the hitting face is enhanced.

Particularly in an iron-type golf club head, the hitting point tends to be located on the lower side (sole side). Since the configuration X1 can enhance the rebound performance when the hitting point is located on the lower side, the configuration X1 effectively enhances the rebound performance of the iron-type golf club head.

The thin portion 150 can reduce the rigidity of a basal portion of the back support portion 130, and can facilitate the leaning deformation. Thus, the deformation of the face plate f1 is increased, and the rebound performance is enhanced. From this viewpoint, the thin portion 150 has a thickness of preferably less than or equal to 4 mm, more preferably less than or equal to 3 mm, and still more preferably less than or equal to 2.5 mm. From the viewpoint of strength, the thickness of the thin portion 150 is preferably greater than or equal to 0.5 mm, and more preferably greater than or equal to 1 mm. The thickness of the thin portion 150 is measured along the up-down direction.

A double-pointed arrow W1 in FIG. 8 indicates a width in the face-back direction of the thin portion 150. From the viewpoint of facilitating the leaning deformation of the back support portion 130 and enhancing the rebound performance, the face-back direction width W1 of the thin portion 150 is preferably greater than or equal to 1 mm, more preferably greater than or equal to 2 mm, still more preferably greater than or equal to 3 mm, and yet still more preferably greater than or equal to 5 mm. Considering the dimensions and weight of the head, the face-back direction width W1 of the thin portion 150 is preferably less than or equal to 20 mm, more preferably less than or equal to 18 mm, and still more preferably less than or equal to 16 mm.

As described above, the second member b1 is welded to the first member h1. The boundary line k1 between the first member h1 and the second member b1 is also the welding position k2. The welding position k2 is a welding position on the outer surface of the head.

A double-pointed arrow W3 in FIG. 8 indicates a distance between the welding position k2 and the end 136. The distance W3 is measured along the face-back direction. In the present embodiment, the distance W3 is equal to the above-described width W1. Weld bead is formed on the welding portion which is the boundary between the first member h1 and the second member b1. The rigidity of the portion on which weld bead is formed is enhanced. If the weld bead is located too closer to the end 136, the enhanced rigidity by the weld bead can hinder the leaning deformation of the back support portion 130. From this viewpoint, the distance W3 is preferably greater than or equal to 1 mm, more preferably greater than or equal to 2 mm, still more preferably greater than or equal to 3 mm, and yet still more preferably greater than or equal to 5 mm. Considering the dimensions of the head, the distance W3 is preferably less than or equal to 20 mm, more preferably less than or equal to 18 mm, and still more preferably less than or equal to 16 mm.

A double-pointed arrow W4 in FIG. 8 indicates a distance between the upper end 140 of the abutting region Rc and the lower end 136 of the rear surface 134. This distance is measured along the up-down direction. From the viewpoint of facilitating the leaning deformation of the back support portion 130 and enhancing the rebound performance, the distance W4 is preferably greater than or equal to 0.5 mm, more preferably greater than or equal to 1 mm, still more preferably greater than or equal to 2 mm, and yet still more preferably greater than or equal to 3 mm. If the abutting region Rc is excessively large, the deformation of the face plate f1 can be suppressed. From this viewpoint, the distance W4 is preferably less than or equal to 10 mm, more preferably less than or equal to 8 mm, and still more preferably less than or equal to 6 mm.

From the viewpoint of rebound performance, the back support portion in the abutting region Rc has a thickness of preferably less than or equal to 4 mm, more preferably less than or equal to 3 mm, and still more preferably less than or equal to 2.5 mm. Considering strength, the thickness of the back support portion in the abutting region Rc is preferably greater than or equal to 0.5 mm, more preferably greater than or equal to 1 mm, and still more preferably greater than or equal to 1.2 mm. This thickness is measured along the face-back direction.

From the viewpoint of rebound performance, a portion that satisfies the configuration X1 has a length in the toe-heel direction of preferably large. A double-pointed arrow G1 in FIG. 1 indicates a length in the toe-heel direction of the longest face line gv1. A double-pointed arrow L1 in FIG. 5 indicates a length in the toe-heel direction of the portion satisfying the configuration X1. From the viewpoint of rebound performance, L1/G1 is preferably greater than or equal to 0.5, more preferably greater than or equal to 0.7, and still more preferably greater than or equal to 0.9. From the viewpoint of restrictions on the dimensions of the head, L1/G1 is preferably less than or equal to 1.3, more preferably less than or equal to 1.2, and still more preferably less than or equal to 1.1.

Figure 12:
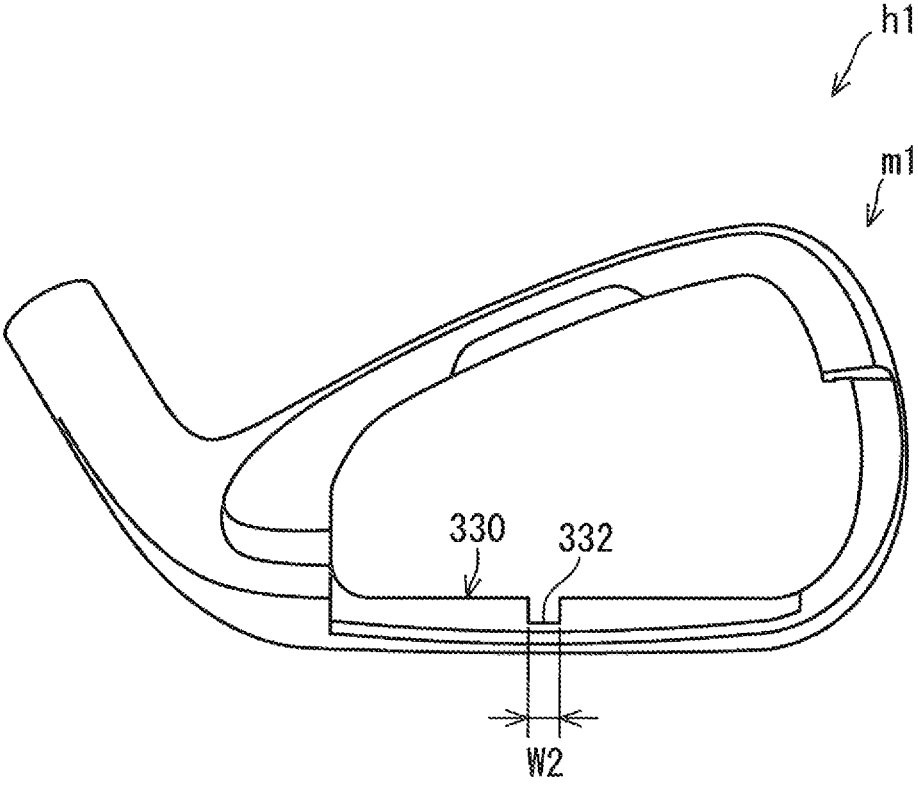
FIG. 12 is a back view of a first member according to a third embodiment.

FIG. 12 is a back view of a first member h1 according to a third embodiment. The first member h1 includes a back support portion 330. The back support portion 330 is provided with an aperture portion 332. The aperture portion 332 is formed such that a part of the back support portion 330 is absent. In the present embodiment, the number of the aperture portion 332 is 1. Except for the presence of the aperture portion 332, the configuration of the head according to the third embodiment is the same as that of the above-described head 100.

Because of the aperture portion 332, a part of the outer peripheral edge portion of the face plate is not supported by the back support portion 330. Further, the aperture portion 332 eliminates a part of the back support portion 330 and reduces the rigidity of the back support portion 330. As a result, the deformation of the face plate f1 becomes large, and the rebound performance is enhanced.

In the third embodiment, the aperture portion 332 is provided at a position corresponding to the face center. In other words, the scope of presence in the toe-heel direction of the aperture portion 332 includes the position in the toe-heel direction of the face center. The aperture portion 332 enhances the rebound performance when hitting is performed on the lower side of the face center.

Figure 13:
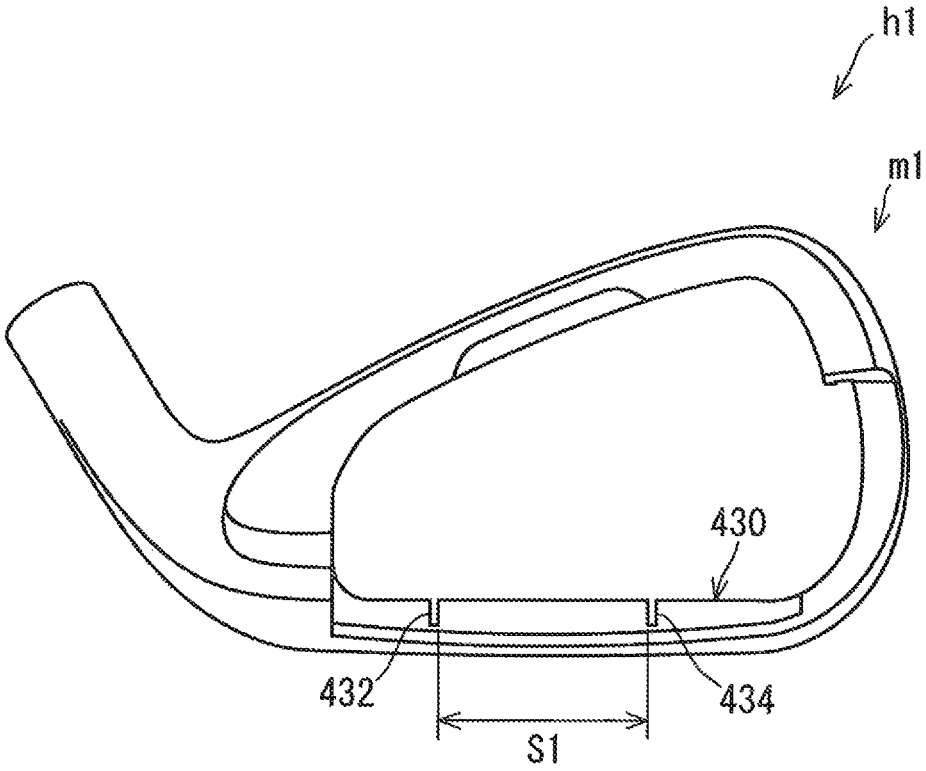
FIG. 13 is a back view of a first member according to a fourth embodiment.

FIG. 13 is a back view of a first member h1 according to a fourth embodiment. The first member h1 includes a back support portion 430. Except for the presence of aperture portions described later, the head according to the fourth embodiment is the same as the above-described head 100.

In the present embodiment, a plurality of aperture portions are provided. The back support portion 430 is provided with a first aperture portion 432 and a second aperture portion 434. The first aperture portion 432 is provided on the heel side relative to the second aperture portion 434. The first aperture portion 432 is provided on the heel side relative to the face center. The second aperture portion 434 is provided on the toe side relative to the face center. The aperture portions 432 and 434 reduce the rigidity of the back support portion 430. The rigidity of a portion between the first aperture portion 432 and the second aperture portion 434 is particularly effectively reduced. As a result, the leaning deformation of the back support portion 430 becomes large to improve the rebound performance.

Thus, such one or more aperture portions can improve the rebound performance.

A double-pointed arrow S1 in FIG. 13 indicates an interval distance between the aperture portions. When a plurality of aperture portions are provided, the interval distance S1 between at least one pair of adjacent aperture portions is preferably greater than or equal to 10 mm, and more preferably greater than or equal to 15 mm. When the interval distance S1 is set to be larger, a part of the back support portion which is present between the aperture portions is made longer. This portion between the aperture portions easily deforms, and contributes to improvement in rebound performance. Considering the dimensions of the head, the interval distance S1 is preferably less than or equal to 80 mm.

A double-pointed arrow W2 in FIG. 12 indicates a width of the aperture portion. From the viewpoint of rebound performance, the width W2 of the aperture portion is preferably greater than or equal to 1 mm. Considering strength, the width W2 of the aperture portion is preferably less than or equal to 15 mm. When the back support portion is located in the sole-side region, the width W2 of the aperture portion is measured along the toe-heel direction.

From the viewpoint of rebound performance, the aperture portion is preferably provided in a presence scope Rg of the longest face line gv1 (see FIG. 1). The presence scope Rg of the longest face line gv1 is a scope in the toe-heel direction and ranges from a toe-side end Pt of the longest face line gv1 to a heel-side end Ph of the longest face line gv1. The aperture portion 332, and the aperture portions 432 and 434 are provided in the presence scope Rg of the longest face line gv1.

The aperture portion may be formed over the entirety in the height direction of the back support portion. In other words, the aperture portion may extend from the face-center-side end of the rear surface to the face-peripheral-side end of the rear surface. The aperture portion located in the sole-side region may extend from the upper end of the rear surface to the lower end of the rear surface. In this case, the leaning deformation of the back support portion is further facilitated.

In the head 100 described above, the back support portion 130 is provided over the entire periphery of the opening 120. The back support portion 130 which is continuous to have an annular shape is less likely to deform. When the aperture portion is provided in the back support portion 130, the rigidity of the back support portion 130 can be effectively reduced.

Figure 14:
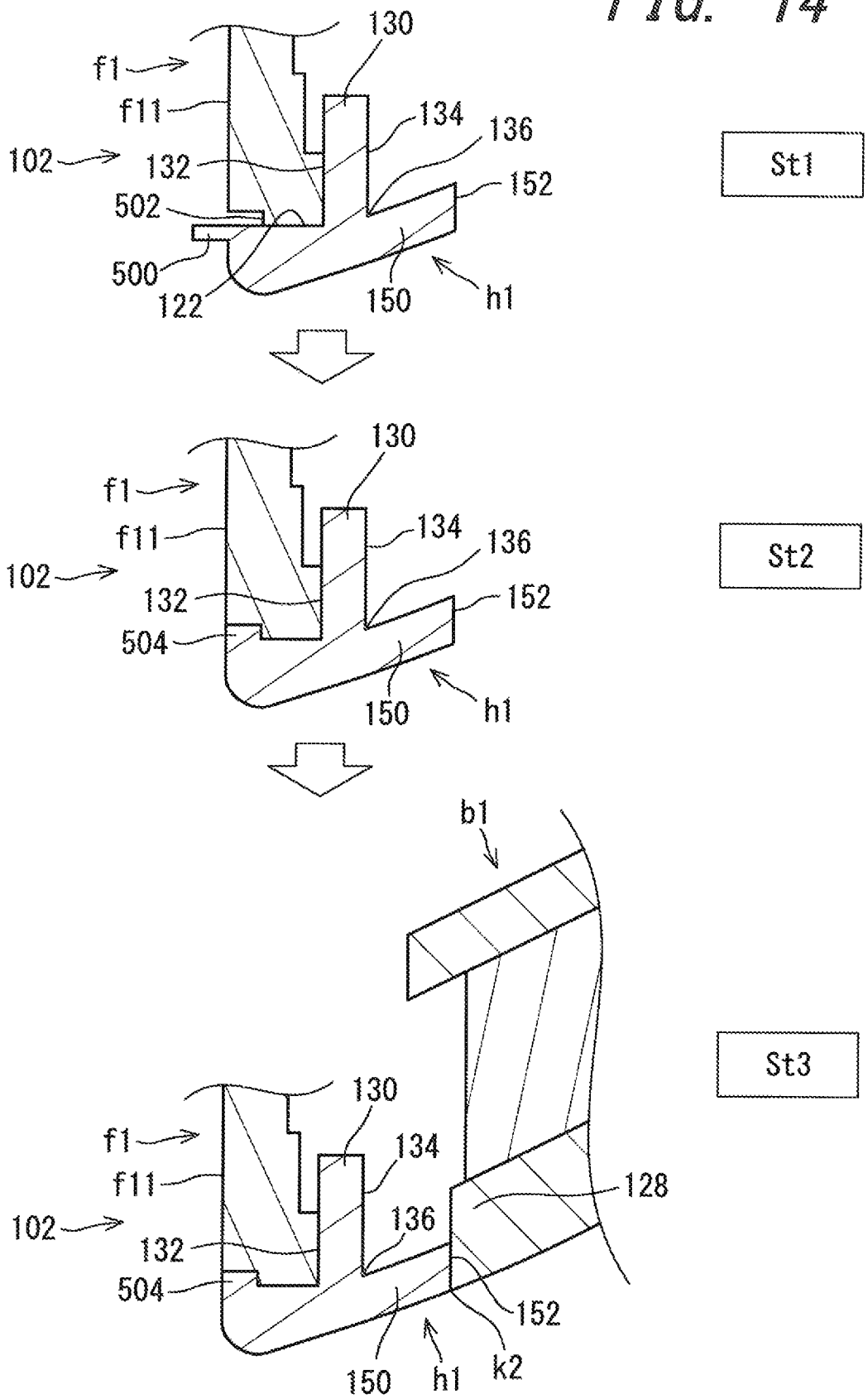
FIG. 14 is a process drawing showing a method for producing the head of the first embodiment.

FIG. 14 is a process drawing showing a method for producing the head 100. In a state where the face plate f1 is not yet attached to the first member h1, the first member h1 includes a caulking protrusion 500. The caulking protrusion 500 is a protruding portion (wall portion) provided along the outer edge of the opening 120. The caulking protrusion 500 is provided over the entire periphery of the opening 120. The caulking protrusion 500 is provided on the hitting face 102. Meanwhile, the plate front surface f11 of the face plate f1 includes a step portion 502 on the outer edge of the plate front surface f11. In the step portion 502, the plate front surface f11 is recessed.

This production method includes the following steps (see FIG. 14).

(1) First step St1 of placing the face plate f1 at the opening 120 of the first member h1.

(2) Second step St2 of forming a holding portion 504 on the face side of the step portion 502 by plastically deforming the caulking protrusion 500.

(3) Third step St3 of joining the second member b1 to the first member h1.

The second step St2 is performed after the first step St1. The third step St3 is performed after the second step St2.

The second step St2 is also referred to as a caulking process. In this caulking process, the caulking protrusion 500 is squashed. As a result, the holding portion 504 is formed. In the head 100, the holding portion 504 is formed over the entire periphery of the face plate f1. In the caulking process, the face plate f1 is pressed when the caulking protrusion 500 is squashed. This pressing force is transmitted to the back receiving surface 132. In the caulking process, the back receiving surface 132 is pressed by the face plate f1. In the caulking process, the caulking protrusion 500 is squashed and the face plate f1 is also pressed. When the face plate f1 is pressed, the back support portion 130 is pressed. A strong force is applied to the back support portion 130.

In this way, the head 100 is produced by a method including the following process Y.

[Process Y] Process in which the back receiving surface 132 is pressed by the face plate f1.

The above caulking process is an example of the process Y.

In the process Y, the back support portion 130 is pressed by the face plate f1. For this reason, the back support portion 130 requires rigidity and strength for enduring this pressing force. From this viewpoint, a back support portion having a high rigidity such as the back support portion 302 in FIG. 11 is preferable. However, in this case, the back support portion is less likely to deform at impact, which results in reduced rebound performance.

The process Y is performed on the first member h1 before the second member b1 is attached thereto. As described above, the second member b1 includes the rearward disposed portion 128 to be located on the back side of the rear surface 134. The rearward disposed portion 128 becomes an obstacle to supporting the rear surface 134 from the back side. In this production method, the process Y is performed in a state where the second member b1 including the rearward disposed portion 128 is absent, and thus the rear surface 134 can be easily supported from the back side. Therefore, even when the rigidity of the back support portion 130 is low, the process Y can be smoothly performed.

Therefore, the head 100 is preferably produced by a method including the following process Y1.

[Process Y1]: Process in which the back receiving surface 132 is pressed by the face plate f1 while the rear surface 134 is supported by a jig.

From the viewpoint of easiness of supporting the rear surface 134, the process Y1 is preferably performed on the first member h1 to which the second member b1 is not yet attached.

The head in which the face plate f1 is fixed to the head body hb1 by caulking is produced by a method that essentially includes the process Y. Therefore, in this head, the head body hb1 preferably includes the first member h1 and the second member b1.

The process Y is not limited to the caulking process. For example, a head in which the face plate f1 is press-fitted into the opening 120 of the first member h1 is produced by a method including the process Y. In this head, the face plate f1 is press-fitted into the opening of the first member h1 in the step St1. In this press-fitting, the face plate f1 is fitted into the opening 120 in a state where the opening inner surface 122 is pressed by the plate side surface f13. Also in this head, the head body hb1 preferably includes the first member h1 and the second member b1.

A head in which the face plate f1 is adhered to the back receiving surface 132 with an adhesive is produced by a method including the process Y, because, in this adhesion, the adhesive is hardened in a state where the face plate f1 is pressed against the back receiving surface 132. Therefore, also in this head, the head body hb1 preferably includes the first member h1 and the second member b1. This adhesion is employed preferably when the material of the face plate f1 is a non-metal such as an FRP (fiber reinforced plastic).

A head in which the face plate f1 is pressed to join with the back receiving surface 132 is produced by a method including the process Y. Therefore, also in this head, the head body hb1 preferably includes the first member h1 and the second member b1.

EXAMPLES

Example

A head that was the same as the head 100 of the first embodiment was produced. The first member h1 was produced by casting (lost-wax precision casting). The material of the first member h1 was stainless steel. The face plate f1 was produced by subjecting a rolled material to NC machining. The material of the face plate f1 was a titanium alloy. The second member b1 was produced by casting (lost-wax precision casting). The material of the second member b1 was stainless steel. The weight wt was produced by powder sintering. The material of the weight wt was a tungsten-nickel alloy. The weight wt was fixed with an adhesive to a weight pocket provided on the second member b1.

While the back support portion 130 was supported by a jig from the back side, the face plate f1 was press-fitted into the opening 120 of the first member h1. Next, while the back support portion 130 was supported by the jig from the back side, the caulking protrusion 500 of the first member h1 was plastically deformed to form the holding portion 504 on the face side of the step portion 502. Then, the second member b1 was welded to the first member h1, and surface finishing such as polishing was performed to obtain a head. The head was a number 6 iron.

Comparative Example

A head that was the same as the head 300 shown in FIG. 11 was produced. The head of Comparative Example was obtained in the same manner as in Example except that the head body hb1 had the same structure as that shown in FIG. 11.

[Evaluation]

Values of COR for the respective heads were measured at 3 points: the face center (point FC); a point (point D5) separated by 5 mm toward the lower side from the face center; and a point (point D10) separated by 10 mm toward the lower side from the face center. The COR means a coefficient of restitution. The COR was measured according to "Interim Procedure for Measuring the Coefficient of Restitution of an Iron Clubhead Relative to a Baseline Plate Revision 1.3 Jan. 1, 2006" specified by USGA (United States Golf Association).

In each of Example and Comparative Example, ratios (%) of the measured CORs to the COR measured at the face center were as follows.

Example

Point FC: 100%
Point D5: 102%
Point D10: 100%

Comparative Example

Point FC: 100%
Point D5: 101%
Point D10: 99%

Thus, the reduction rate of the COR at the hitting point on the lower side in Example was smaller than that in Comparative Example.

The following clauses are disclosed regarding the above-described embodiments.

[Clause 1]

A golf club head including:
a head body including a sole; and
a face plate fixed to the head body, wherein
the face plate includes:
a plate front surface forming a part of a hitting face;
a plate rear surface that is a surface opposite to the plate front surface; and
a plate side surface extending between the plate front surface and the plate rear surface,
the head body includes:
an opening at which the face plate is disposed; and
a back support portion that supports the face plate from a back side,
the back support portion includes:
a back receiving surface that abuts on an outer peripheral edge portion of the plate rear surface to form an abutting region; and
a rear surface that is a surface opposite to the back receiving surface, and
a face-peripheral-side end of the rear surface is located on a face peripheral side relative to a face-center-side end of the abutting region.

[Clause 2]

The golf club head according to clause 1, wherein
the back support portion abuts on a part of the outer peripheral edge portion which is located in a sole-side region of the plate rear surface, and
a lower end of the rear surface is located on a lower side relative to an upper end of the abutting region.

[Clause 3]

The golf club head according to clause 2, wherein
the sole includes a thin portion located on the back side of the rear surface,
the lower end of the rear surface is an intersection line between an inner surface of the thin portion and the rear surface, and
the thin portion has a thickness of less than or equal to 4 mm.

[Clause 4]

The golf club head according to clause 2 or 3, wherein
the golf club head is an iron-type golf club head.

[Clause 5]

The golf club head according to any one of clauses 1 to 4, wherein
the back support portion further includes an aperture portion formed such that a part of the back support portion is absent.

[Clause 6]

The golf club head according to any one of clauses 1 to 5, wherein
the head body includes a rearward disposed portion that is disposed on the back side of the back support portion, and a clearance formed between the back support portion and the rearward disposed portion, and the hitting face includes a specific measurement point, a measurement of a COR at the specific measurement point bringing the back support portion into contact with the rearward disposed portion.

[Clause 7]

The golf club head according to any one of clauses 1 to 6, wherein the head body includes:

a first member that includes the back support portion, the face plate being fixed to the first member; and a second member joined to the first member, and the second member includes a rearward disposed portion that is disposed on the back side of the back support portion.

The above description is merely an example, and various changes can be made without departing from the essence of the present disclosure.

What is claimed is:

1. A golf club head comprising:

a head body including a sole; and a face plate fixed to the head body, wherein the face plate includes:

a plate front surface forming a part of a hitting face;

a plate rear surface that is a surface opposite to the plate front surface; and a plate side surface extending between the plate front surface and the plate rear surface, the head body includes:

an opening at which the face plate is disposed; and a back support portion that supports the face plate from a back side, the back support portion includes:

a back receiving surface that abuts on an outer peripheral edge portion of the plate rear surface to form an abutting region; and a rear surface that is a surface opposite to the back receiving surface, a face-peripheral-side end of the rear surface is located on a face peripheral side relative to a face-center-side end of the abutting region, and the head body includes a rearward disposed portion that is disposed on the back side of the rear surface of the back support portion, and a clearance is formed between the rear surface and the rearward disposed portion.

2. The golf club head according to claim 1, wherein the back support portion abuts on a part of the outer peripheral edge portion which is located in a sole-side region of the plate rear surface, and a lower end of the rear surface is located on a lower side relative to an upper end of the abutting region.

3. The golf club head according to claim 2, wherein the sole includes a thin portion located on the back side of the rear surface, the lower end of the rear surface is an intersection line between an inner surface of the thin portion and the rear surface, and the thin portion has a thickness of less than or equal to 4 mm.

4. The golf club head according to claim 3, wherein the thin portion is a thinnest portion in the sole.

5. The golf club head according to claim 3, wherein the thin portion has a face-back direction width of greater than or equal to 1 mm and less than or equal to 20 mm.

6. The golf club head according to claim 2, wherein the golf club head is an iron-type golf club head.

7. The golf club head according to claim 1, wherein the back support portion further includes an aperture portion formed such that a part of the back support portion is absent.

8. The golf club head according to claim 1, wherein the hitting face includes a specific measurement point, a measurement of a COR at the specific measurement point bringing the back support portion into contact with the rearward disposed portion.

9. The golf club head according to claim 8, wherein the measurement of the COR at a maximum restitution point bringing the back support portion into contact with the rearward disposed portion.

10. The golf club head according to claim 1, wherein the head body includes:

a first member that includes the back support portion, the face plate being fixed to the first member; and a second member joined to the first member, and the second member includes a rearward disposed portion that is disposed on the back side of the back support portion.

11. The golf club head according to claim 1, wherein in a sole-side region, a lower end of the rear surface is located on a lower side relative to an upper end of the abutting region.

12. The golf club head according to claim 1, wherein in a top-side region, an upper end of the rear surface is located on an upper side relative to a lower end of the abutting region.

13. The golf club head according to claim 1, wherein the golf club head further includes a back cavity, and a space formed by the clearance is continuous with the back cavity.

14. The golf club head according to claim 1, wherein the back support portion in the abutting region has a thickness of greater than or equal to 0.5 mm and less than or equal to 4 mm.

15. The golf club head according to claim 1, wherein the rearward disposed portion is attached only at the sole of the head body.

16. The golf club head according to claim 1, wherein the rearward disposed portion and the clearance are present in a sole-side region.

17. A golf club head comprising:

a head body including a sole; and a face plate fixed to the head body, wherein the face plate includes:

a plate front surface forming a part of a hitting face;

a plate rear surface that is a surface opposite to the plate front surface; and a plate side surface extending between the plate front surface and the plate rear surface, the head body includes:

an opening at which the face plate is disposed; and a back support portion that supports the face plate from a back side, the back support portion includes:

a back receiving surface that abuts on an outer peripheral edge portion of the plate rear surface to form an abutting region; and a rear surface that is a surface opposite to the back receiving surface, a face-peripheral-side end of the rear surface is located on a face peripheral side relative to a face-center-side end of the abutting region, the back support portion abuts on a part of the outer peripheral edge portion which is located in a sole-side region of the plate rear surface, a lower end of the rear surface is located on a lower side relative to an upper end of the abutting region, the sole includes a thin portion located on the back side of the rear surface, the lower end of the rear surface is an intersection line between an inner surface of the thin portion and the rear surface, and the thin portion has a thickness of less than or equal to 4 mm.

18. A golf club head comprising:

a head body including a sole; and a face plate fixed to the head body, wherein the face plate includes:

a plate front surface forming a part of a hitting face;

a plate rear surface that is a surface opposite to the plate front surface; and a plate side surface extending between the plate front surface and the plate rear surface, the head body includes:

an opening at which the face plate is disposed; and a back support portion that supports the face plate from a back side, the back support portion includes:

a back receiving surface that abuts on an outer peripheral edge portion of the plate rear surface to form an abutting region; and a rear surface that is a surface opposite to the back receiving surface, a face-peripheral-side end of the rear surface is located on a face peripheral side relative to a face-center-side end of the abutting region, the head body includes a rearward disposed portion that is disposed on the back side of the back support portion, and a clearance formed between the back support portion and the rearward disposed portion, and the hitting face includes a specific measurement point, a measurement of a COR at the specific measurement point bringing the back support portion into contact with the rearward disposed portion.

19. A golf club head comprising:

a head body including a sole; and a face plate fixed to the head body, wherein the face plate includes:

a plate front surface forming a part of a hitting face;

a plate rear surface that is a surface opposite to the plate front surface; and a plate side surface extending between the plate front surface and the plate rear surface, the head body includes:

an opening at which the face plate is disposed; and a back support portion that supports the face plate from a back side, the back support portion includes:

a back receiving surface that abuts on an outer peripheral edge portion of the plate rear surface to form an abutting region; and a rear surface that is a surface opposite to the back receiving surface, a face-peripheral-side end of the rear surface is located on a face peripheral side relative to a face-center-side end of the abutting region, the golf club head further includes a back cavity, the head body includes: a rearward disposed portion that is disposed on the back side of the back support portion; and a clearance formed between the back support portion and the rearward disposed portion, and a space formed by the clearance is continuous with the back cavity.

* * * * *